United States Patent [19]

Buecheler et al.

[11] Patent Number: 4,915,267

[45] Date of Patent: Apr. 10, 1990

[54] DISPENSING STORAGE CONTAINER FOR A LAUNDRY TREATMENT MATERIAL

[75] Inventors: Herbert Buecheler, Erkrath; Peter Kittscher, Kaarst; Paul-Otto Weltgen, Hilden, all of Fed. Rep. of Germany

[73] Assignee: Henkel Kommanditgesellshaft auf Aktien, Duesseldorf, Fed. Rep. of Germany

[21] Appl. No.: 203,657

[22] Filed: Jun. 7, 1988

[30] Foreign Application Priority Data

Feb. 25, 1988 [DE] Fed. Rep. of Germany ..... 3804667

[51] Int. Cl.[4] ..... B67D 5/64

[52] U.S. Cl. ..... 222/463; 222/482; 68/17 R

[58] Field of Search ..... 222/463, 482, 190, 188, 222/545; 206/204, 320, 77.1; 68/17 R, 17 A

[56] References Cited

U.S. PATENT DOCUMENTS

| | | | |
|---|---|---|---|
| 225,785 | 3/1880 | Beattie | 222/463 |
| 2,956,709 | 10/1960 | Nison et al. | 222/463 |
| 3,192,923 | 7/1965 | Ackerman | 128/65 |
| 3,399,806 | 9/1968 | Lucas | 222/5.45 |
| 3,620,054 | 11/1971 | Drews et al. | 68/17 A |
| 3,727,808 | 4/1973 | Fitzgerald | 222/482 |
| 4,118,957 | 10/1978 | Marcussen | 68/17 A |
| 4,703,872 | 11/1987 | Cornette et al. | 222/158 |

FOREIGN PATENT DOCUMENTS

| | | |
|---|---|---|
| 216415 | 1/1987 | European Pat. Off. . |
| 0248341 | 12/1987 | European Pat. Off. . |
| 8509898 | 8/1985 | Fed. Rep. of Germany . |
| 2157718A | 10/1985 | United Kingdom . |

*Primary Examiner*—Kevin P. Shaver
*Assistant Examiner*—Kenneth Noland
*Attorney, Agent, or Firm*—Ernest G. Szoke; Wayne C. Jaeschke

[57] ABSTRACT

A dispensing storage container comprising a somewhat spherical housing forming a storage compartment for a supply of laundry treatment liquid and having an inlet/-outlet portion, which may also be a removable cover portion. The inlet/outlet portion comprises a recessed groove, preferably annular, surrounded by elevated surface areas of the housing, and having inlet/outlet openings recessed at the base of the groove.

9 Claims, 3 Drawing Sheets

DISPENSING STORAGE CONTAINER FOR A LAUNDRY TREATMENT MATERIAL

BACKGROUND OF THE INVENTION

1. Field of the Invention

This invention relates to a container designed to be filled with laundry treatment material, such as liquid detergent, and placed into a washing chamber, such as an automatic washing machine, and being capable of dispensing the contents into the wash water containing the laundry during the washing cycle.

2. Statement of the Prior Art

In prior-known dispensing storage containers designed to be filled with liquid detergent and placed into the wash water to dispense the contents during the washing cycle, the design of the containers has been found to produce one or more unsatisfactory results relating to the filling of the containers and, more particularly, to the ability of the containers to uniformly and completely dispense their contents during the washing cycle.

U.S. Pat. No. 3,399,806 discloses dispensing storage containers which are designed for a single use in that they contain a seal between the filled compartment and a dispensing opening, which seal is dissolved or broken during the initial use. The contents then flow out through one large opening, according to one embodiment, or through several small openings in the base of a puncture insert, according to another embodiment.

The advantage of these designs is that the containers empty almost completely. Depending on the shape of the storage container, however, the liquid flows out in much the same way as it does when poured from a bottle. In the full upside-down position, uniform outflow is greatly affected by the inflowing displacement air. The inflow of water through the same openings, which water creates a favorable diluting and flushing-out effect, interferes with the uniform outflow of the liquid detergent to an even greater extent than air. The same adverse interference effect which occurs on the inflow of water into the cylindrical, neck-like depression and through the apertures of the puncture insert of U.S. Pat. No. 3,399,806 will also occur if the dispensing storage container is refilled with liquid detergent through the openings, for example for a second use. Attempts have already been made to improve these disadvantages by providing segregated outlet and inlet openings, as disclosed in West German Gebrauschmuster GM 85 09 898, which illustrates at least one filling opening and several outlet openings. In particular, one proposed dispensing storage container has a filling opening which is designed to be closed by a cover comprising the outlet openings. This design has the disadvantage that the outlet openings are not recessed, i.e. can easily be blocked by an item of laundry during use, which can also cause the amount of liquid released per unit of time to vary. In another variant of the solution of the interference problem disclosed in the above-cited utility model specification, this problem is overcome by the provision of a filling funnel fixedly associated with the storage container in the form of a centrally directed tube which has the filling or inlet openings at its lower end and the outlet openings in the funnel wall near the upper edge of the funnel. However, it has been found by extensive tests that the distinction made in this utility model specification between filling opening and outlet openings is based on an error of fact. The laundry treatment liquid flows out mainly from the filling openings when the dispensing storgage container circulates in the drum of the washing machine, embedded in the laundry. The centrally directed funnel tube actually leads to highly irregular release of the laundry treatment liquid to such an extent that, in the beginning, the quantity of liquid flowing out per unit of time amounts to several times the quantity which can flow out from the dispensing storage container when it is in the upside-down position and the liquid level of the contents falls below the level of the filling openings. There is also the disadvantage that the liquid is released much the same way as it issues when poured from a standard bottle. In addition, neither filling with liquid detergent nor the inflow of washing liquid is optimal. When the liquid is poured in, splashing readily occurs, and the water inlet openings are situated too centrally to permit adequate flushing out the container.

An objective of the present invention is to design a dispensing storage container of the aforementioned type in such a way that, in addition to the advantage of substantially uniform release of liquid detergent with improved surface distribution, the inflow of liquid is optimized whether for pouring in of the laundry treatment liquid during filling and/or for the inflow of water during the washing process.

DESCRIPTION OF THE INVENTION

Figure 1:
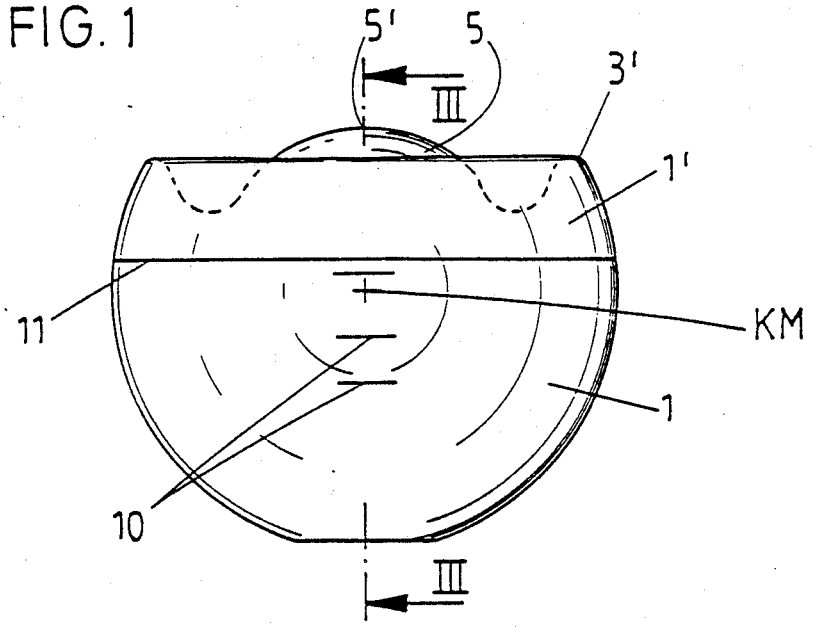
FIG. 1 is an elevation view of a dispensing storage container according to a preferred embodiment of the present invention.

The present invention provides a dispensing storage container for accommodating and dispensing a laundry treatment liquid in a washing machine or the like, the container having openings which not only provide favorable filling/inflow through the openings, but also provide for uniform release of liquid per unit of time and in a favorable surface distribution. The container has a central elevation which is above the elevation of the openings. This elevation not only prevents obstruction of the openings by items of washing, but also promotes the distribution of liquid accompanying the circulating movement during the washing process. It is even possible, without affecting the filling advantages, to modify the dispensing dosage by modifying the dimensions of the openings. The dome-shaped elevation also promotes filling of the container with liquid detergent by causing the liquid to flow thereover and be distributed as a laminar, turbulence-free inflow to the inlet openings. The steeply terminating shape of the dome causes the liquid to run down from the dome with no turbulence so that the openings at the base of the dome are never completely filled with the liquid being introduced, and the displaced air is able to escape. This flow of the liquid to the holes optimizes the distribution of liquid so that, in particular, no splashing, bubble formation or the like can occur. There is also the advantage that the danger of overfilling is minimal because it is possible to see in advance when the liquid level is approaching the region of the base of the dome containing the openings. The spherical shape of the elevation or dome regulates the tumbling movement of the container in the washing machine or the like, which contributes towards standardizing the quantity of liquid released. Through its weight, the residue initially remaining in the interior recess of the dome represents an orienting means which promotes the optimal position of the container for the residual outflow. Mainly, however, this design provides for optimal stability of the storage container against deformation under the loads applied by the items of laundry or by centrifugal force. The present design even makes it possible to use storage containers which are made from relatively thin plastics material and yet which are capable of withstanding relatively heavy loads.

In cases where the dome and openings are provided on a separate cover portion, the remainder of the container may even be deformable, either by manual compression or under the loads encountered in the washing machine or the like. The fact that the apex of the dome projects beyond the edge of the groove containing the openings also promotes release of the liquid, mainly during tumbling.

Further advantages and particulars will become apparent from the following description of an embodiment of the invention illustrated in the accompanying drawings.

The accompanying drawings illustrate two different embodiments of the present invention, both of which comprise a somewhat spherical walled housing forming a storage compartment therewithin and having an open end over which a dispensing cover 1' is attachable to form the dispensing storage container 1.

Figure 2:
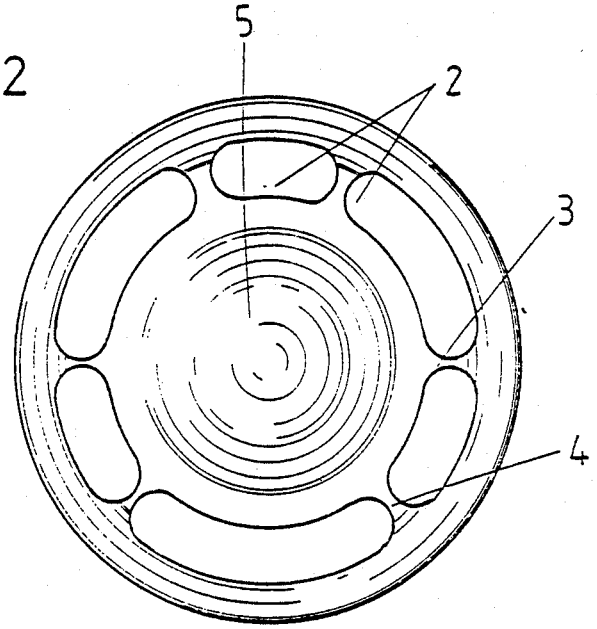
FIG. 2 is a plan view of the container of FIG. 1.
Figure 3:
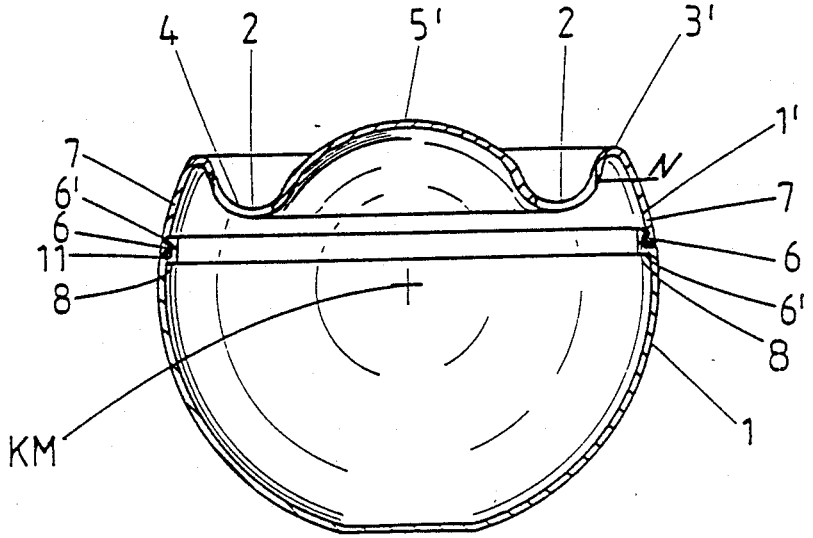
FIG. 3 is a section taken along the line III—III in FIG. 1.

In the embodiment of FIGS. 1 to 3 the walled housing is provided at the open end thereof with a recessed peripheral collar 8 having a continuous groove 6', and the cover 1' is provided with an inner peripheral bead 6 on the rim 7 adjacent the open end thereof, whereby the cover 1' can be snapped into the housing by engagement of the bead 6 within the groove 6' to provide a smooth outer surface on the spherical container 1.

The storage container 1, more specifically the cover 1', comprises the openings 2 which are arranged at the base 3 of an annular groove 4 having a uniform cross-section. The annular groove 4 extends concentrically to a dome-shaped elevation 5. The apex 5' of this dome-shaped elevation projects beyond the top edge 3' of the cover 1', beyond the groove. The groove 4 and the dome 5 are provided on the cover 1' which is snap-fitted onto the storage container 1 by means of the projection bead or bead segments 6, shown in FIG. 3, on the rim 7 of the cover 1' which cooperate with counter-projections or recess 6' on the rim of flange 8 encircling the opening of the container 1 like a recessed collar.

In addition, the dispensing storage container preferably is translucent and includes level markings 10, shown in FIG. 1.

In the illustrated embodment, the storage container 1 is substantially spherical in shape. The cover attachment joint 11 of the cover 1' is situated above the center KM of the sphere and extends in a secant plane to this sphere. The base of the groove 4 is also situated on such a secant plane.

The number and size of the openings 2 is determined by the consistency of the laundry treatment fluid being used, for example a liquid detergent, and also by the amount of liquid desired to be dispensed per unit of time. The conditions for the filling process will depend upon the size of the groove, particularly its cross-section. Alternatively, the cover may be designed to be removed for filling which, of course, is the quickest way of filling the container compartment.

Figure 4:
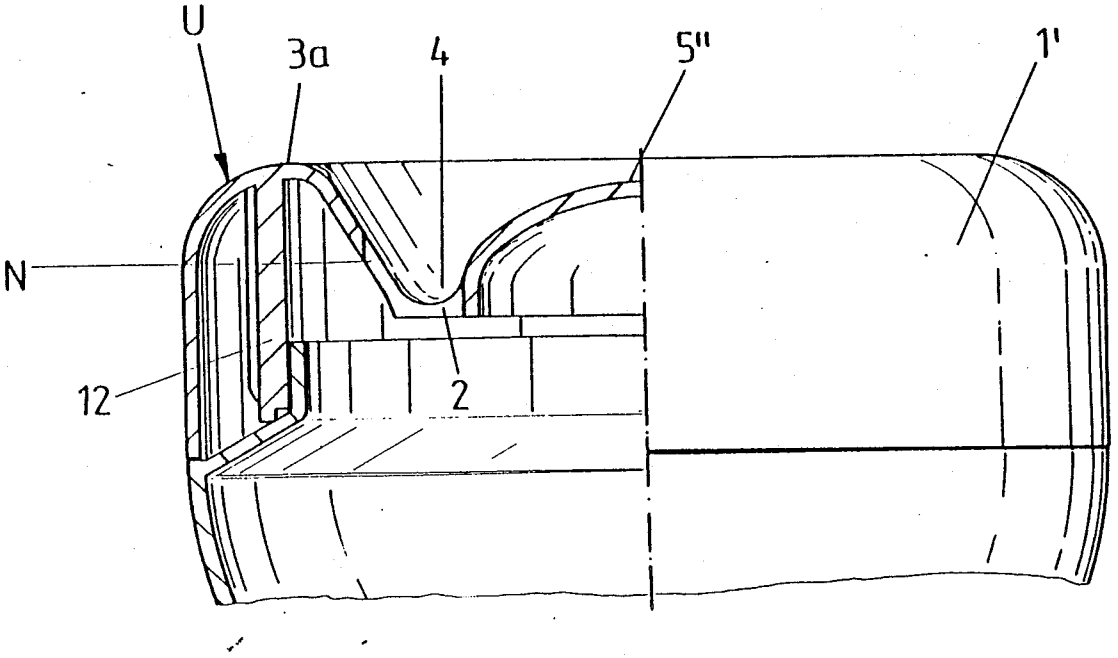
FIG. 4 is a half-section through a slightly modified design of the cover.

In the design shown in FIG. 4, the cover 1' is provided with a top edge 3a which extends in a relatively large, almost uniform curve (comparable with the internal width of the groove 4) from the surface of the container into the base region of the groove 4 provided with the openings 2. This shape provides for effective tumbling of the container, even when the apex 5' of the dome 5'' does not project beyond the top edge 3a of the cover 1'. Also this design creates increased runaway surfaces for the laundry treatment liquid after it has passed through the openings 2. These tapered groove surfaces extend to a higher level N on the outside of the groove 4 than on the inside of the groove 4, adjacent the dome 5'. Thus the openings 2 extend further up the outside wall of the groove, which also permits the free escape of air during the filling operation.

In the embodiment of FIG. 4, the container 1 has a cover-engaging collar which is offset radially inwardly from the maximum diameter of the housing and the cover 1' has a double wall construction including a stabilizing collar-engaging inner wall 12 and an outer wall which merges smoothly with the container housing when the cover is secured.

A presently preferred embodiment of the invention has herein been described and modifications to this presently preferred embodiment may. occur to those having skill in the art. It is thus intended that the invention not be limited to only the embodiment disclosed above but the invention be limited only as defined by the appended claims.

We claim:

1. A dispensing storage container for accommodating and dispensing a laundry treatment liquid within a washing machine or other washing compartment, said container comprising a walled housing forming a storage compartment designed to contain a supply of said liquid, said housing having an inlet/outlet portion designed to permit introduction of said liquid during filling and to permit uniform dispensing of said liquid and displacement thereof with washing water during use of the container within a washing machine or compartment, said inlet/outlet portion being a groove comprising a portion of said housing which is depressed to form an annular recess located between an outer elevated portion of said housing, forming an outer rim of said groove, and a central elevated portion of the housing, and a plurality of recessed openings spaced along the base of said groove so as to be recessed below said elevated central portion of the outer surface of said housing, said annular recess comprising inner and outer walls which taper down to form the base of said groove containing said openings, and said openings extending from said base up into said outer wall to cause the laundry treatment liquid to be dispensed onto said tapered outer wall during use, and to permit displaced air to escape from said container during the step of filling the container with laundry treatment liquid, said groove permitting laundry treatment liquid to be poured therein for free entry into the storage compartment through said recessed openings, and said recessed openings being protected against blockage for the free dispensing of the laundry treatment liquid during use.

2. A dispensing storage container according to clain 1 in which said central elevated portion comprises a rounded dome which tapers down into said groove.

3. A dispensing storage container according to claim 1 in which said container is substantially spherical in shape and said groove is located along a secant plane of said container.

4. A dispensing storage container according to claim 1 in which the apex of said central elevated portion extends above the apex of the housing at the outer edge of said groove.

5. A dispensing storage container according to claim 1 in which the cross-section of said groove is equal to or smaller than the cross-section of the portion of the housing forming the outer rim of said groove.

6. A dispensing storage container for accommodating and dispensing a laundry treatment liquid within a washing machine or other washing compartment, said container comprising a walled housing forming a storage compartment designed to contain a supply of said liquid, said housing having an inlet/outlet portion designed to permit introduction of said liquid during filling and to permit uniform dispensing of said liquid and displacement thereof with washing water during use of the container within a washing machine or compartment, said inlet/outlet portion comprising a portion of said housing which is depressed to form a groove surrounded by elevated portions of the housing, and a plurality of recessed openings spaced along the base of said groove so as to be recessed below the elevated portions of the outer surface of said housing, said recessed openings extending outwardly from the base of said groove up into said elevated portions of said housing surrounding said groove to facilitate the escape of air during the filling of the container, said groove permitting laundry treatment liquid to be poured therein for free entry into the storage compartment through said recessed openings, and said recessed openings being protected against blockage for the free dispensing of the laundry treatment liquid during use.

7. A dispensing storage container according to claim 6 in which said inlet/outlet portion of the housing comprises a removable cover portion of the container.

8. A dispensing storage container according to claim 7 in which the outer surface of the cover portion merges smoothly with the outer surface of said housing.

9. A dispensing storage container according to claim 7 in which said cover portion is attached to said housing along a secant plane located above the center of the housing.

* * * * *